US008353629B2

(12) United States Patent
Johnsen

(10) Patent No.: US 8,353,629 B2
(45) Date of Patent: Jan. 15, 2013

(54) SUSTAINABLE SELF-ATTACHING BAG

(76) Inventor: Bernadette Reshell Johnsen, Jackson, MI (US)

( * ) Notice: Subject to any disclaimer, the term of this patent is extended or adjusted under 35 U.S.C. 154(b) by 691 days.

(21) Appl. No.: 12/287,329

(22) Filed: Oct. 8, 2008

(65) Prior Publication Data

US 2010/0002959 A1 Jan. 7, 2010

Related U.S. Application Data

(60) Provisional application No. 60/978,322, filed on Oct. 8, 2007.

(51) Int. Cl.
*B65D 33/06* (2006.01)
*B65D 30/20* (2006.01)

(52) U.S. Cl. ..... 383/12; 383/120

(58) Field of Classification Search ..... 383/12, 383/8, 15, 17, 23

See application file for complete search history.

(56) References Cited

U.S. PATENT DOCUMENTS 5,938,033 A * 8/1999 Huang et al. ..... 206/554
6,382,429 B1 * 5/2002 Yeh et al. ..... 211/59.1
2006/0177641 A1 * 8/2006 Breese et al. ..... 428/220

* cited by examiner

*Primary Examiner* — Nathan J Newhouse
*Assistant Examiner* — Christopher Demeree
(74) *Attorney, Agent, or Firm* — Robert L. McKellar; McKellar IP Law, PLLC

(57) ABSTRACT

Present invention provides for self attachment of a sustainable fabric t-shirt bag to a usually stationary support frame by means of tabs that are secured across the midsection of the continuous integral looped handles that are laterally spaced and extending upward from the base. A hole is thereby created for the threading onto the rode supports of the check out frames.

The four sides that project upwards from the base of said bag, form a front and back wall along with two sides created by a gusset, creating an open mouth between the bases of the pair of handles by which articles can be received, retained and carried within. This invention can replace the stacks of plastic grocery bags that are presently found on many store check out frames today and end up as liter all over our planet as garbage.

4 Claims, 6 Drawing Sheets

SUSTAINABLE SELF-ATTACHING BAG

BACKGROUND

During the previous decades, plastic t-shirt bags for the most part have been readily available in grocery and retail stores mounted on racks for consecutive detachment of the bags from a stack of plastic bags, by consumers for the receiving and retaining of products to be carried. Many of these bags end up literally becoming fly away liter, being consumed by animals in an attempt to retrieve food from within, found along highways and roads and ending up in our land fills. The disposal of paper and plastic bags has put a great burden on the environment as has the overflow in the landfills. Society is quickly becoming a bring your own bag community. Consumers are able to purchase a reusable bag in almost every grocery store today and in numerous retail shops with handles that don't readily accommodate the support check out frames in stores.

Most of those reusable bags sold today, have handles that are facing in the wrong direction and are frequently too long. The twisting of the handles and sometimes excessive length make it cumbersome to maintain an open mouth for the receiving of articles to be retained and carried.

This invention creates a hole under the tab located at the midsection and across the top of the continuous loop handle that is in a more efficacious location for threading the two laterally spaced handles of said bag onto the rod supports of the support frames, thereby, making it easier and more practical to secure said bag for the receiving and retaining of articles to be carried, making it a more practical and useful bag to utilize over other bags on the market today. This invention provides for a practical and ideal solution to stopping the excessive use of plastic bags.

SUMMARY

A sustainable self attaching t-shirt bag has two laterally spaced continuous looped handles with a tab secured at the top of the midsection of the handles creating an open hole between the tab and the continuous loop allowing for the securing of said bag to a structural frame for the purpose of receiving and retaining of articles to be carried in the body of the bag.

T-shirt bag is made out of one pattern and one piece of fabric. Trim of any size and make such as material, string, bias, chain, leather, nylon can be applied to the laterally placed continuous looped handles and used as the tab which is secured to the edges of the midsection of the top of the handle it's self, for the purpose of utilizing it to create the hole for the insertion of a stationary device.

The bag is comprised of four sides projecting upward from the bases. On each side of the bag mouth, there are two laterally spaced pair of handles extending upwardly from the base of the bag, forming an integral pair of laterally spaced continuous loop handles extending upward. The open end edges of the handles are stitched together and top stitched for extra strength. The sides edges which are left exposed, are then trimmed with any fabric, bias, decorative piece of material, or leather. The tab may be constructed out of any of the previously mentioned materials.

The tabs are secured to both side edges of the upper midsection of the continuous looped handles and covered with the trim for extra strength in securing the bag to the store check out frames or any device that is intended for it to positioned for the receiving and the retaining of articles to be carried. The present location of said tabs on the midsection and across the top of the said handle creating a hole between the tab and the handle, make it a more efficacious location for threading the two laterally spaced handles of said bag onto the rod supports of the support frames, thereby making it easier and more practical to secure said bag for the filling of it with articles over other bags which have handles that are attached and facing in the other direction.

The four sides projecting upward from the bases on each side of bag mouth create an open orifice for the receiving and retaining of articles to be carried. The front and back edges are connected together and then folded downward and outwardly and then secured below the lower base without any cutting of the fabric to form gussets providing a continuous bag periphery at the approximate level at the base making it a stronger and more durable bag to reuse.

DRAWINGS

These and other features, aspects, and advantages of the present invention will become better understood with regard to the following description and accompanying drawings where:

DETAILED DESCRIPTION

Figure 1:
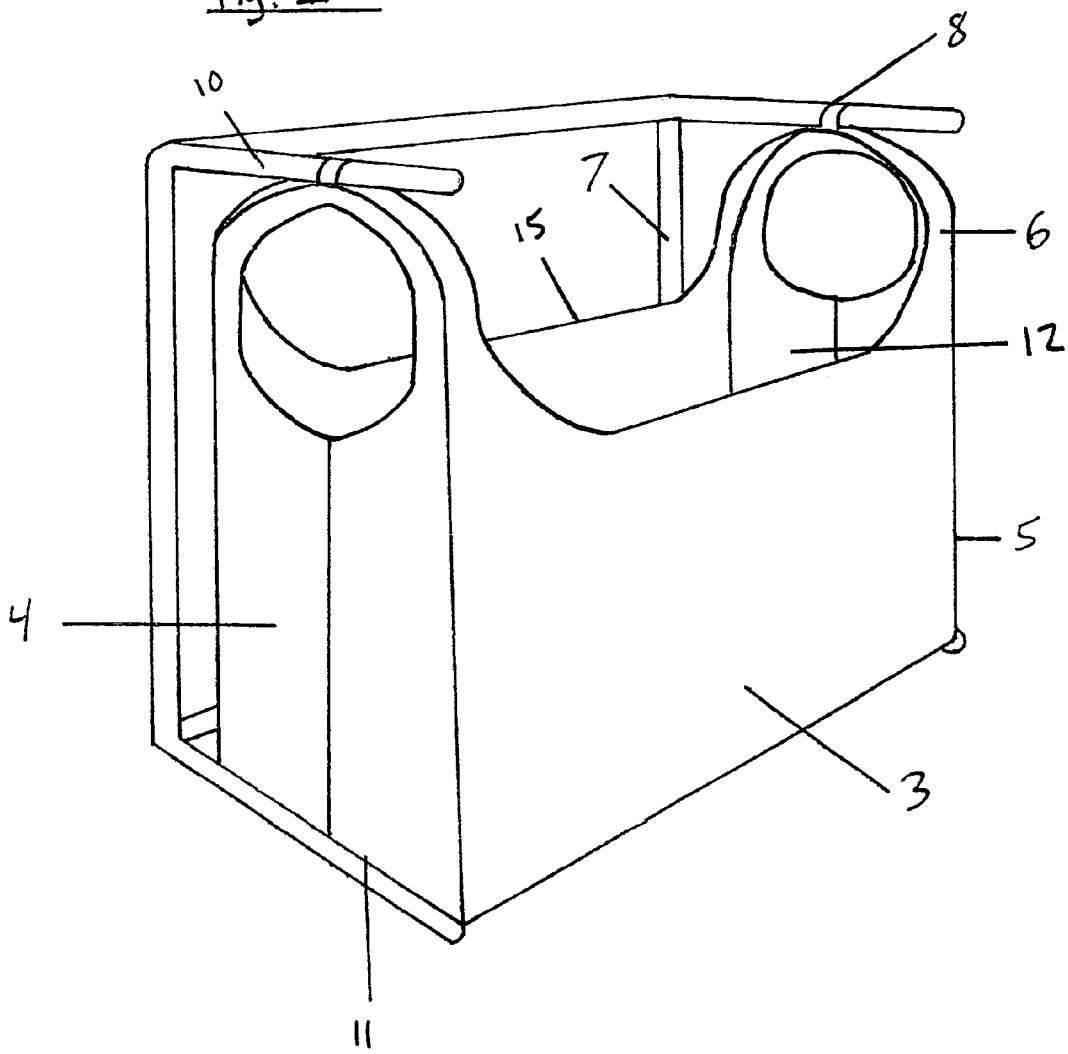
FIG. 1 is a front and side view of a bag with the attaching loop handles and tabs located at the top of the handles which show that it is secured on the check out frame; gusseted side of the bag also being displayed.

Referring now to FIG. 1, illustrates a front 3 and side 4 view of a sustainable t-shirt style bag 5 with the attaching continuous loop handles 6 being secured to the frame 7 with tabs 8 that have been configured to create a hole 9 under the tab 8 and above the handle 6. As illustrated in FIG. 1, the placement of the tabs 8 make it a more efficacious location for threading the two laterally spaced handles 6 of the bag 5 onto the rod supports 10 of the support frame 7. As seen in FIG. 1, it would be convenient and easy to secure it for the loading of the bag 5 with articles without being unencumbered by any object from the bag 5. FIG. 1 illustrates that the sides of the bag 5 are gusseted 11 for the purpose of creating an opening 12 for the receiving of goods.

Figure 2:
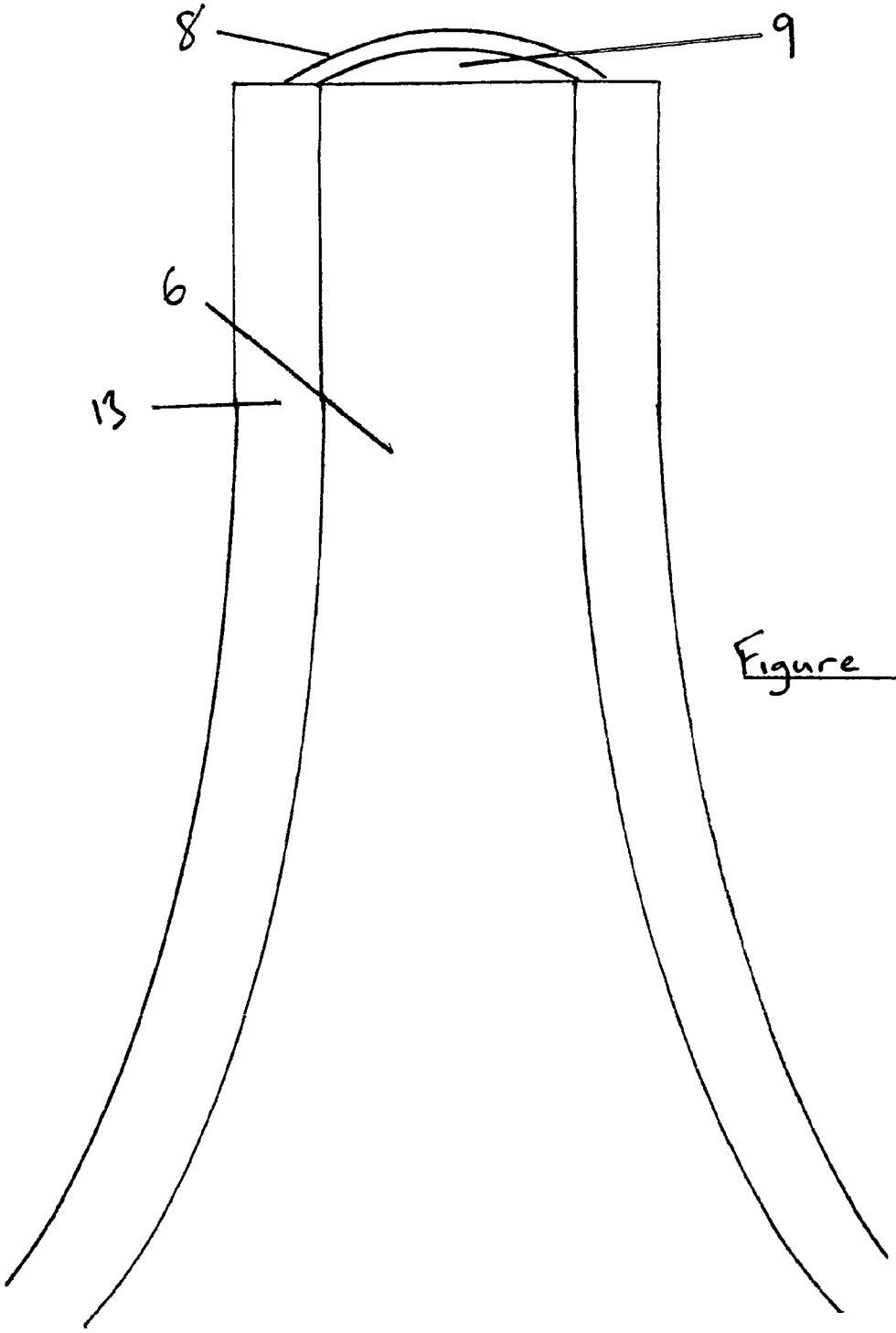
FIG. 2 is the handle with the tab located at the top of it and is attached underneath the trim.

FIG. 2. illustrates the tab 8 and how it has created an opening for the rod of the support 10 frame 7 to go through it easily and without any twisting of the handle 6 which would block the path for the insertion of items. FIG. 1, illustrates that the tab 8 is secured underneath the trim 13 at its edges so as to leave an open 9 area below the tab 8 and above the handle 6. The intention of my invention to provide a bag 5 that is more easily threaded onto a rod support 10 without twisting handles 6 and also to eliminate the falling off of handles 6 because hey are either too long and or twisted at the same time. There is not to my knowledge a bag 5 on the market that I am aware of, that has a designed based upon a utilitarian and properly functioning basis behind its design, for use with the present day check out frames 7 in most of the stores.

DETAILED DESCRIPTION CONTINUED

Figure 3:
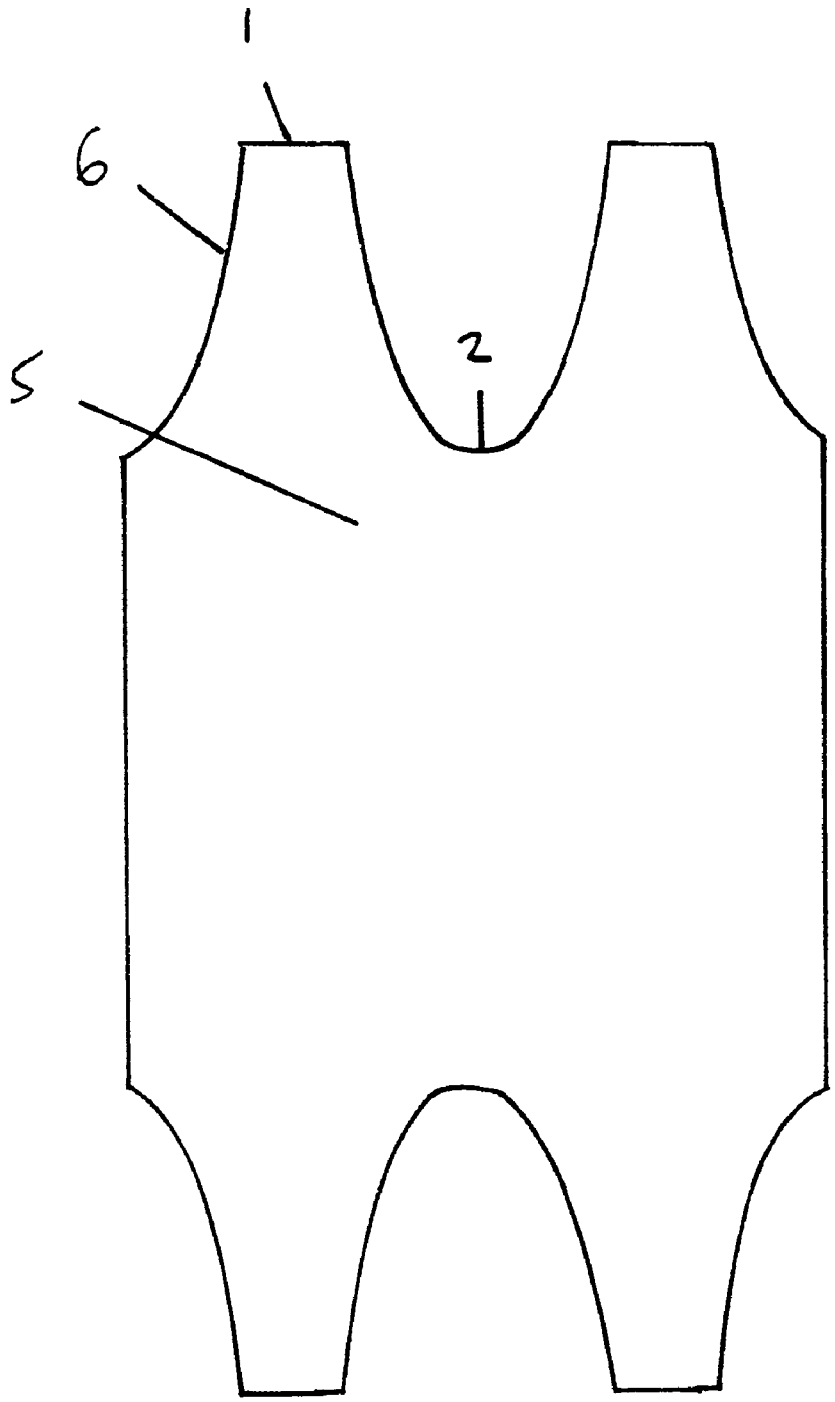
FIG. 3 is the pattern of the bag open before it is sewn together.

FIG. 3, illustrates a simple cut out pattern for the t-shirt style bag 5 that I have created for the functional use of a bag that easily fits on the check out frames 7 so that we can reuse the frames 7 that are already made and being used today. FIG. 3, The end of the handles 6 that are stitched together and hold making it a peripheral unit. FIG.3, The opening to the mouth 2 of the bag 5 which allows for items to be inserted as the said bag 5 is attached by means of the tabs 8 to the checkout frames 7.

Figure 4:
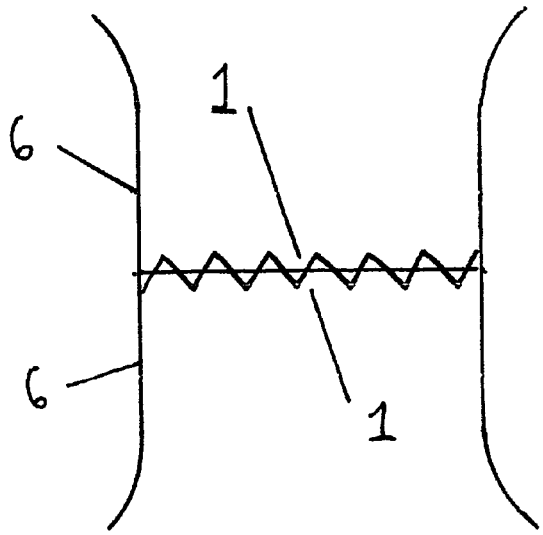
FIG. 4 is the ends of the handles sewn together before the trim and the tabs are attached to the handle.

FIG. 4, illustrates the two ends of the handles 6 attached together before the tab 8 is secured to the side edges of the handles 6.

Figure 5:
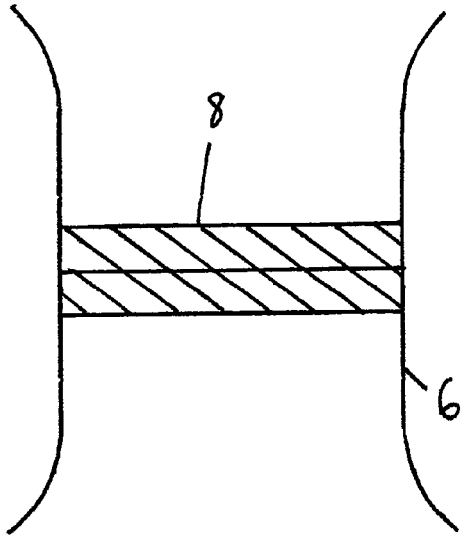
FIG. 5 is the tab attached to the top of the handle creating a hole for a more efficacious location for the threading of rod support of the support frame.

FIG. 5, illustrates the tab 8 in place before the trim 13 is applied. The tabs 8 can be made out of a variety of materials, ribbons, bias and in different widths depending upon the type of fabric chosen for the particular bag.

Figure 6:
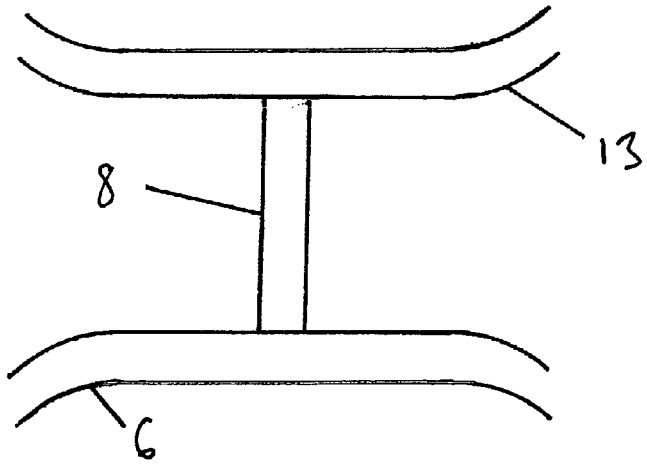
FIG. 6 is the trim attached over the tab which is then attached to the handle.

FIG. 6, illustrates the trim 13 that has been applied above and below the tab 8 for securing it in place on the end of the handle.

Figure 7:
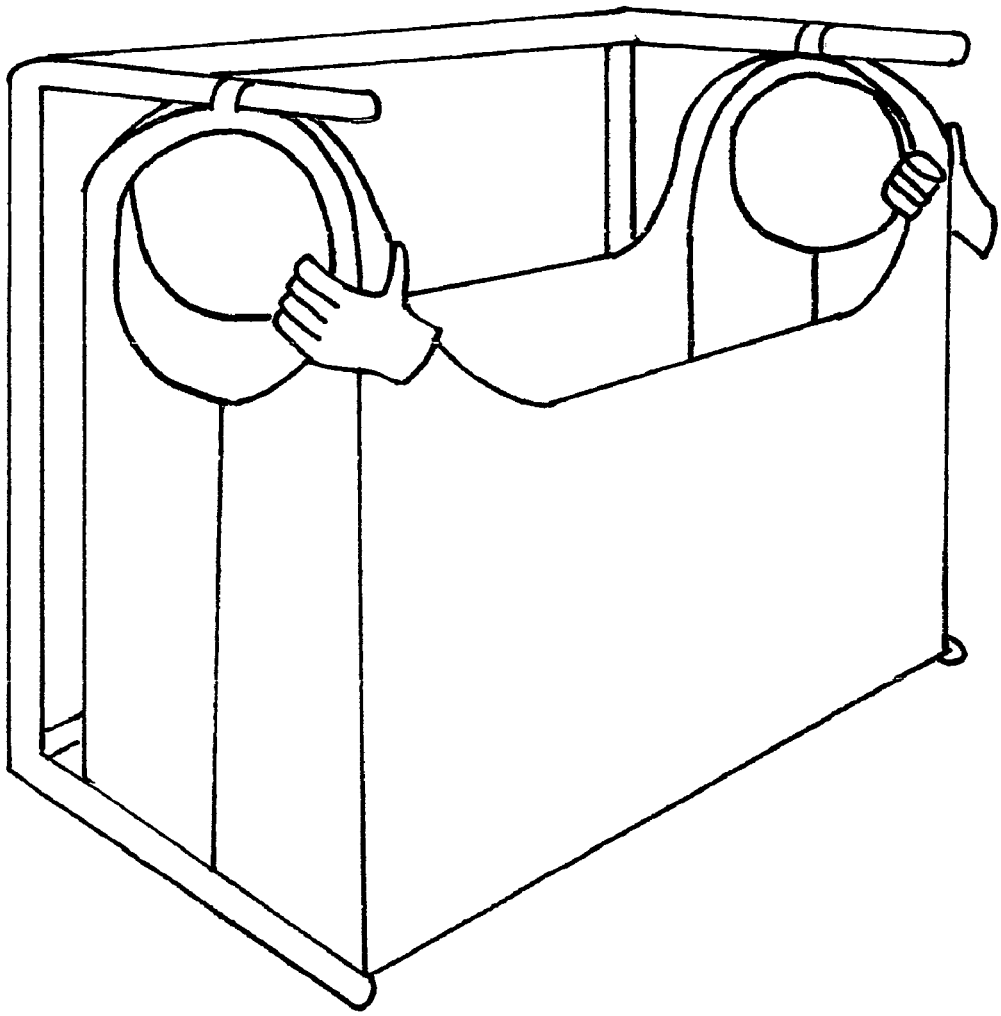
FIG. 7 is showing the opening of said bag that is not encumbered by twisted handles or too long of a handle which would make it difficult to load with articles if they were in the way of the open mouth of the body of the bag.

FIG. 7, illustrates how the bag 5 is place on and off the rod support frame 7 without the handles 6 being twisted.

Figure 8:
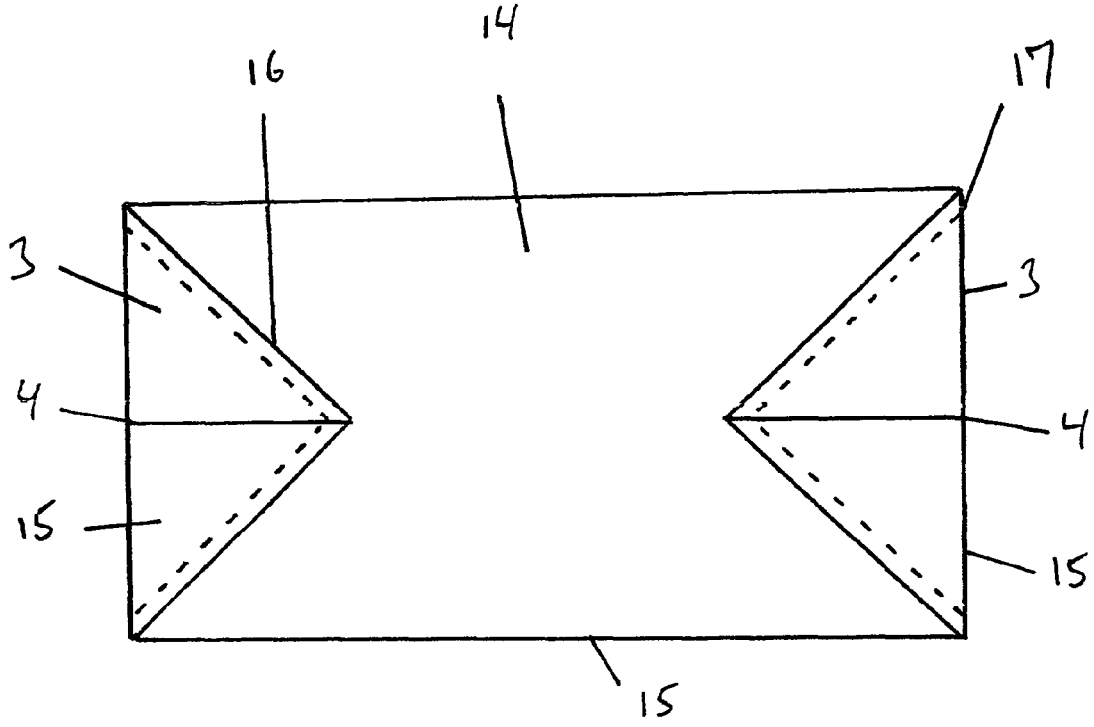
FIG. 8 is the bottom corners of the bag turned underneath and outwardly and attached below the bag.

FIG. 8, illustrates the bottom 14 of the bag 5 with the two sides 4 of the bags 5 which are the front 3and back 15 are turned underneath 16 and top stitched in place outwardly for the purpose of creating a gusset 11 and make the bag 5 stronger as no fabric is cut from the bag 5.

DETAILED DESCRIPTION CONTINUED

It is my intention to promote this bag 5 to the grocery store management who are presently providing thousands of plastic bags everyday to their customers. I have a web site where bags 5 may be purchased. This bag encourages people to reuse and recycle. It is my desire to see the present day check out frames utilized so that they are not discarded like so many other things that have been thrown away in the paste. Consumers who have already purchased my sustainable self attaching bag state that they enjoy its many uses. It may be used in the home setting for kids toys, towels and carrying items to and from the car. It is a multipurpose bag 5.

What is claimed is:

1. A sustainable fabric t-shirt bag comprised of four sides projecting upward from bases on each side of a bag mouth, two laterally spaced pair of handles extending upwardly from said bases; a front and back wall secured together at the side and across a continuous upper handle edge of two long sides, mid section and across the top of continuous loops each having a tab with ends that are located centrally at the top of the handle loops, with each of the ends centrally secured, creating an open hole between the tab and the continuous loop handles, making it a more efficacious location for threading the two laterally spaced handles of said bag onto a support frame, thereby making it easier and more practical to secure said bag for the receiving and retaining of articles to be carried; said front and back edges of the sides being folded downward and outwardly and secured below the lower base without any cutting of the fabric to form gussets providing a continuous bag periphery at the approximate level at the base.

2. The bag as described in claim 1 wherein the placement of the tab allows for a more efficacious location for threading the two laterally spaced handles onto the support frame.

3. The bag as described in claim 1 wherein the placement of the tab allows for a convenient and easy method of securing the bag to the support frame and loading with items.

4. The bag as described in claim 1 wherein the placement of the tab allows for an open an unencumbered mouth of said bag.

* * * * *